US005965484A

United States Patent [19]

Kohno et al.

[11] Patent Number: 5,965,484

[45] Date of Patent: Oct. 12, 1999

[54] REVERSIBLE HEAT-SENSITIVE RECORDING MEDIUM

[75] Inventors: Kenji Kohno, Ibaraki; Hiroyuki Mitsuhashi, Kyoto; Junko Ozaki, Ibaraki; Kazushi Miyata, Osaka-fu, all of Japan

[73] Assignee: Hitachi Maxell, Ltd., Osaka-fu, Japan

[21] Appl. No.: 09/038,129

[22] Filed: Mar. 11, 1998

[30] Foreign Application Priority Data

Mar. 11, 1997 [JP] Japan ..... 9-076497

[51] Int. Cl.[6] ..... B41M 5/36; B41M 5/40

[52] U.S. Cl. ..... 503/207; 503/200; 503/201; 503/226

[58] Field of Search ..... 427/150–152; 503/200, 201, 207, 226

[56] References Cited

U.S. PATENT DOCUMENTS 4,268,413 5/1981 Dabisch ..... 252/408

4,695,528 9/1987 Dabisch et al. ..... 430/290

FOREIGN PATENT DOCUMENTS 64-14077 1/1989 Japan ..... 503/201

*Primary Examiner*—Bruce H. Hess

*Attorney, Agent, or Firm*—Birch, Stewart, Kolasch & Birch, LLP

[57] ABSTRACT

A reversible heat-sensitive recording medium comprising a support; a heat-sensitive layer formed on top of the support, which layer comprises a resin matrix and a low molecular weight organic compound dispersed in said matrix, and a transparency of which is reversibly changeable depending on the temperature, in which a conductive powder is contained in at least a part of the support and heat-sensitive layer, which medium has a low-surface resistivity and excellent anti-static properties.

3 Claims, No Drawings

REVERSIBLE HEAT-SENSITIVE RECORDING MEDIUM

BACKGROUND OF THE INVENTION

1. Field of the Invention

The present invention relates to a reversible heat-sensitive recording medium that has a heat-sensitive layer in which the transparency reversibly changes depending on the temperature, and image formation and deletion, based on a change in temperature, can occur repeatedly. More specifically, the present invention relates to a reversible heat-sensitive recording medium that has a low surface resistivity and excellent anti-static properties.

2. Background of the Invention

Hitherto, as heat-sensitive recording media that can reversibly record and delete data, media are provided, which have a heat-sensitive layer in which low molecular weight organic compounds such as higher alcohols, higher fatty acids or the like are dispersed within a resin matrix such as polyvinyl chloride, polyester, polyamide, or the like, and they utilize temperature-dependent transparency changes from transparent to cloudy or cloudy to transparent in the formation and deletion of images (see JP-A-54-119377, JP-A-55-154198 and JP-A-64-14077).

However, this type of heat-sensitive layer is formed in a surface layer portion of a support having a thickness in the range of several $\mu$m to several ten $\mu$m, and has a high electrical resistance because the raw materials are non-conductive. Thus, the layer is easily charged, and dust and other dirt is picked up, and sticking may arise when used as a sheet. Moreover, problems such as poor conveyance when used while being inserted into machinery, poor conveyance in the production process, discharge and the like often arise.

SUMMARY OF THE INVENTION

The present invention intends to provide a reversible heat-sensitive recording medium in which problems resulting from static charge do not arise, because it has a low surface resistivity and favorable anti-static properties.

Accordingly, the present invention provides a reversible heat-sensitive recording medium comprising a support;

a heat-sensitive layer formed on top of the support, which layer comprises a resin matrix and a low molecular weight organic compound dispersed in said matrix, and a transparency of which is reversible depending on the temperature, wherein a conductive powder is contained in at least a part of the support and heat-sensitive layer.

The reversible heat-sensitive recording medium of the present invention may further comprise a protective layer formed on top of the heat-sensitive or on the underside of the support, or intermediate layers formed between the support and each layer, and a conductive powder is contained in at least a part of the support, heat sensitive layer, protective layer and intermediate layers.

DETAILED DESCRIPTION OF THE INVENTION

In the present invention, generally any conductive powders may be used. Examples of the conductive powder are tin oxide (antimony-doped, phosphorous-doped), tin-indium oxide, zinc oxide (aluminum-doped), titanium oxide (nitrogen-doped), or their coatings on core materials such as barium sulfate, titanium oxide, aluminum borate, or potassium titanate, etc. However, the conductive powder is not limited to the above, but may simply be a conductive powder that does not interfere with the visibility of the heat-sensitive records and maintains the transparency. Preferably, the conductive powder particles have a minor axis of 1 $\mu$m or less.

The conductive powder may be included in any state. It may be evenly dispersed within the matrix materials, or agglomerated. It may even have a very uneven distribution, provided the necessary surface resistivity can be achieved.

Furthermore, this type of conductive powder may also be included in the support of the reversible heat-sensitive recording. Moreover, when a protective layer or intermediate layers, etc., are suitably prepared on top of the heat-sensitive layer, on the underside of the support, or between the support and each layer, the conductive powder may be contained in any of these layers. Furthermore, it may not only be contained in one of the support, heat sensitive layer and other optional layers, but also in a plurality of them.

The amount of conductive powder is preferably such that the surface resistivity of the finished medium having all the layers is $10^{13}$ Ω/sq. or less.

When conductive powder is contained in the heat-sensitive layer, etc., of the reversible heat-sensitive recording media, sufficiently low surface resistivity can be achieved, and the reversible heat-sensitive recording media with favorable anti-static properties, in which problems resulting from static electricity do not arise, can be obtained.

The heat-sensitive layer is a layer in which the transparency changes reversibly according to the temperature.

Such a layer is prepared by applying a heat-sensitive paint onto the top of the support and then drying it. This paint is made of a thermally soluble low molecular weight organic compound, a matrix resin, a solvent and a conductive powder, etc. blended with any other necessary components. Then, when a heat-sensitive layer prepared in this way is heated using a thermal head or a heating drum, etc., the thermally soluble low molecular weight organic compound melts together with the matrix resin and becomes a film. As a result, the light-scattering on the powder particle surfaces disappear, and thus the layer becomes transparent.

A matrix resin forms a layer in which low molecular weight organic compounds are evenly dispersed and maintained. Because of the great influence of the transparency of the recording layer when transparent, a resin that has high transparency, is mechanically stable, and has good film-forming properties is preferred.

The following can be given as examples of this type of resin:

thermoplastic resins, for example, polyvinyl chloride and vinyl chloride copolymers such as vinyl chloride-vinyl acetate copolymer, vinyl chloride-vinyl acetate-vinyl alcohol copolymer, vinyl chloride-vinyl acetate-acrylic copolymer, vinyl chloride-acrylate copolymer and the like; polyvinylidene chloride and vinylidene chloride copolymers such as vinylidene chloride-vinyl chloride copolymer, vinylidene chloride-acrylonitrile copolymer; polyester; polyamide; polyacrylate or polymethacrylate; acrylate-methacrylate copolymer; silicone resin; polystyrene; styrene-butadiene copolymer; and the like; and thermosetting resins. These matrix resins may be used individually, or two or more of them may be used together.

Furthermore, the low molecular weight organic compound used in the heat-sensitive layer preferably has a melting point of 50° C. or greater. With a melting point of less than 50° C., the compound becomes unstable at room temperature and the level of energy necessary for preserving recording changes. Thus, the transparency energy region shifts, and it becomes impossible to carry out deletion of the records with a fixed energy setting.

The amount of the low molecular weight organic compound is between 10 and 50 wt. parts per 100 wt. parts of the matrix resin.

The following compounds or solid solutions made up of the following compounds can be used as the low molecular weight organic compounds:

an aliphatic ketone having a melting point of no less than 50° C., a higher fatty acid or its ester, a sulfide, an aliphatic dicarboxylic acid, a saturated or unsaturated fatty acid bisamide, an aromatic bisamide, a saturated or unsaturated aliphatic urea, and an aromatic urea.

A solid solution refers to a mixture of two or more individual low molecular weight organic compounds which are dissolved in each other in the solid state. A solid solution is easily formed, when the crystal structures of the compounds closely resemble each other. For aliphatic compounds, a solid solution may easily be obtained when the lengths of the principal carbon chains of compounds are about the same.

The following can be given as examples of aliphatic ketones having a melting point of no less than 50° C.:

dialkyl ketones of the general formula:

$$CH_3(CH_2)_{n-1}CO(CH_2)_{m-1}CH_3$$

wherein n is an integer of 8 or larger, preferably 8 to 29 and m an integer of 8 or larger, preferably 8 to 29), a specific example of which is stearone ($C_{17}H_{35}COC_{17}H_{35}$)

The following can be given as further examples:

methyl alkyl ketones of the general formula:

$$CH_3CO(CH_2)_{p-3}CH_3$$

wherein p is an integer of 17 or larger, preferably 17 to 31, or phenyl alkyl ketones of the general formula:

$$C_6H_5CO(CH_2)_{q-1}CH_3$$

wherein q an integer of 10 or larger, preferably 10 to 29.

Examples of higher fatty acids are myristic acid, pentadecanoic acid, palmitic acid, margaric acid, stearic acid, nonadecanoic acid, eicosanoic acid, heneicosanoic acid, behenic acid, lignoceric acid, pentacosanoic acid, cerotic acid, heptacosanoic acid, montanic acid, triacontanoic acid, nonacosanoic acid, melissic acid, trans-2-octadecenoic acid, trans-4-octadecenoic acid, 2-heptadecenoic acid, trans-gondoic acid, brassidic acid, trans-8-trans-10-octadecadienoic acid, and the like.

The following fatty acid methyl and ethyl esters and esters of higher alcohols can be given as examples of higher fatty acid esters.

Fatty acid methyl and ethyl esters: methyl behenate, methyl tricosanoate, ethyl tricosanoate, methyl lignocerate, ethyl lignocerate, methyl pentacosanoate, ethyl pentacosanoate, methyl cerotate, ethyl cerotate, methyl octacosanoate, ethyl octacosanoate, methyl montanate, ethyl montanate, methyl melissate, ethyl melissate, methyl dotriaconate, ethyl dotriaconate, methyl tetratriacontanoate, ethyl tetratriacontanoate, methyl hexatriacontanoate, ethyl hexatriacontanoate, methyl octatriacontanoate, ethyl octatriacontanoate, methyl hexatetracontanoate, ethyl hexatetracontanoate, pentadecyl palmitate, hexadecyl palmitate, octadecyl palmitate, triacontyl palmitate, tetradecyl stearate, hexadecyl stearate, heptadecyl stearate, octadecyl stearate, hexacosyl stearate, triacontyl stearate, docosyl behenate, tetracosyl lignocerate, myristyl melissate, and the like.

Esters of a higher alcohol: phthalic acid monoesters of primary alcohols having at least 12 carbon atoms, preferably 12 to 30 carbon atoms.

Examples of the sulfides are sulfides of the general formula:

$$HOOC(CH_2)_r—S—(CH_2)_sCOOH$$

wherein r and s are each integers of 1 to 5.

Specific examples of the sulfide are (1,1'-dicarboxy)dimethylsulfide, (2,2'-dicarboxy)diethylsulfide, thiodipropionic acid, (3,3'-dicarboxy)dipropylsulfide, (1,2'-dicarboxy)methylethylsulfide, (1,4'-dicarboxy)methylbutylsulfide, (2,3'-dicarboxy)ethylpropylsulfide, (2,4'-dicarboxy)ethylbutylsulfide, (5,5'-dicarboxy)dipentylsulfide, and so on. Thiodipropionic acid is particularly favorable.

Aliphatic dicarboxylic acids are typically represented by the general formula:

$$HOOC(CH_2)_{t-2}COOH$$

wherein t an integer of 2 or larger, preferably 2 to 30.

Specific examples of aliphatic dicarboxylic acids are oxalic acid, malonic acid, succinic acid, glutaric acid, adipic acid, pimelic acid, suberic acid, azelaic acid, sebacic acid, undecanedioic acid, dodecanedioic acid, tridecanedioic acid, tetradecanedioic acid, pentadecanedioic acid, hexadecanedioic acid, heptadecanedioic acid, octadecanedioic acid, nonadecanedioic acid, eicosanedioic acid, heneicosanedioic acid, docosanedioic acid, tetracosanedioic acid, hexacosanedioic acid, nonacosanedioic acid, dotriacosanedioic acid, and the like.

Examples of saturated fatty acid bisamides are methylene bis-stearic acid amide, ethylene bis-capric acid amide, ethylene bis-lauric acid amide, ethylene bis-stearic acid amide, ethylene bis-isostearic acid amide, ethylene bis-hydroxystearic acid amide, ethylene bis-behenic acid amide, hexamethylene bis-stearic acid amide, hexamethylene bis-hydroxystearic acid amide, N,N'-distearyl adipic acid amide, N,N'-distearylsebacic acid amide, and so on.

Examples of unsaturated fatty acid bisamides are ethylene bis-oleic acid amide, hexamethylene bis-oleic acid amide, N,N'-dioleyladipic acid amide, N,N'-dioleylsebacic acid amide, and so on.

Meta-xylene bis-stearic acid amide, N,N'-distearyl isophthalic acid amide, and the like are examples of aromatic bisamides.

Examples of saturated aliphatic ureas are N-methyl-N'-stearylurea and N-butyl-N'-stearylurea, etc., and examples of saturated aliphatic bisureas are hexamethyl bis-stearylurea and the like.

Examples of unsaturated aliphatic ureas are N-methyl-N'-oleylurea and N-butyl-N'-myristoleylurea, etc., and examples of unsaturated aliphatic bisureas are hexamethylene-bis-oleylurea, hexamethylene-bis-palmitoleylurea and hexamethylene-bis-myristoleylurea, etc.

Examples of aromatic ureas are N-phenyl-N'-stearylurea and the like, and examples of aromatic bisureas are xylene-bis-stearylurea, toluylene-bis-stearylurea, diphenylmethane-bis-stearylurea, diphenylmethane-bis-laurylurea and so on.

The heat-sensitive layer is preferably 1–10 $\mu$m thick. If it is thinner than 1 $\mu$m, then it cannot be made sufficiently opaque, but if it is thicker than 10 $\mu$m, then it cannot be made sufficiently transparent after printing.

Moreover, when a protective layer is prepared on top of the heat-sensitive layer, the protective layer is transparent and formed by applying protective layer paint on top of the heat-sensitive layer and drying it.

The protective layer paint is prepared by mixing a resin with a cross-linking agent, a solvent, and a conductive powder and the like, as well as any other optional components.

The thickness of the protective layer is not limited, but is preferably between 0.5 and 8 μm.

When the protective layer is prepared on top of the heat-sensitive layer, the heat-sensitive layer is sufficiently protected by the protective layer and it is not easily damaged even if it is hit by another body. It also has improved anti-abrasion characteristics. Thus, because it is transparent, it cannot influence a change in the state of the heat-sensitive layer or interfere the reading of the recorded marks in the heat-sensitive layer.

In addition to a protective layer, intermediate layers and the like may be prepared when necessary. They are formed by preparing a paint in which a solvent and conductive powder and fillers, dyestuffs, pigments, and any other components are mixed together, and then applying this paint on the underside of the support, on the support and between adjacent layers as appropriate, and then drying.

The intermediate layers may serve as an adhesive layer, a barrier layer, a coloring layer, and so on.

Additionally, plasticizers, lubricants, dispersants, other reins and the like can be used in the heat-sensitive, protective, and intermediate layers to improve various properties.

As the support for the formation of the heat-sensitive layer and so on, transparent plastic sheets such as polyester, polystyrene, polymethacrylate, polycarbonate, cellophane, cellulose acetate, and the like are preferably used.

The conductive powder can be included in the formation of the support by a process such as blending in with the raw materials. When a support containing a conductive powder is used, the surface resistivity is low and it has good anti-static properties and thus a reversible heat-sensitive medium having no problems due to static charge is obtained.

EXAMPLES

Examples of the present invention will be explained in the following.

Example 1

A heat-sensitive paint was prepared by mixing and dispersing the following components in a small stirring vessel.

| | Wt. parts |
|---|---|
| Stearone | 7.5 |
| Eicosanedioic acid | 0.25 |
| Hexamethylene bis-stearic acid amide | 0.25 |
| Vinyl chloride-vinyl acetate-hydroxypropyl acrylate copolymer (Solbine TA-2, manufactured by Nissin Chemical Industries, Ltd.) | 16 |
| Polypentadiene (Quinton B-170, manufactured by Zeon Co., Ltd.) | 0.16 |
| Colonate HL (an isocyanate cross-linking agent, manufactured by Nippon Polyurethane Ind., Ltd.) | 1.1 |
| Cyclohexanone | 18.75 |
| Methyl isobutyl ketone | 17.75 |
| Toluene | 38.24 |

Then, a 20 μm thick heat-sensitive layer was formed by applying the heat-sensitive paint on top of a 100 μm thick transparent polyester film with a wire bar, heat-drying it, and leaving it to cure at 60° C. for 24 hours.

Then, a 1 μm thick adhesive layer was prepared by applying a solution made from the components given below on top of the aforementioned polyester film using a wire bar, and then heat-drying it.

| | Wt. parts |
|---|---|
| Vinyl acetate resin (polymerization degree, 5000) | 10 |
| Methanol | 90 |

Moreover, a 3 μm thick protective layer containing conductive powder was prepared using a paint made from the components given below.

| | Wt. parts |
|---|---|
| Acrylic type UV curable resin (BR-370, manufactured by Asahi Denka Co., Ltd.) | 20 |
| Tin oxide type conductive powder in the form of 30% dispersion in n-butyl | 50 |

This paint was applied with a wire bar on top of the adhesive layer formed on top of the heat-sensitive layer, which had been formed on top of the aforementioned polyester film. Then, the paint was heat-dried, and cured for 24 hours at 60° C., and a conductive protective layer was obtained.

Thus a reversible heat-sensitive recording medium was prepared.

Comparative Example 1

Apart from the omission of the adhesive layer and the protective layer containing conductive powder, a reversible heat-sensitive recording medium was made in the same manner as for Example 1.

The surface resistivities of the heat-sensitive recording media obtained in Example and Comparative Example were evaluated with a Hirest MODEL HT-210 manufactured by Mitsubishi Chemical Co., Ltd. after an image was formed on the surface with a thermal head having an energy of 0.51 mJ/dot. The results are shown in Table 1.

TABLE 1

| | Surface resistivity (Ω/sq.) |
|---|---|
| Example 1 | $3.2 \times 10^9$ |
| Comp. Example 1 | $>10^{13}$ |

From the results in Table 1, it can be clearly seen that the reversible heat-sensitive recording medium obtained in Example 1 has a lower surface resistivity than the reversible heat-sensitive recording medium obtained in Comparative Example 1. From this, it is understood that reversible heat-sensitive recording media obtained from this invention have low surface resistivity and excellent anti-static properties.

What is claimed is:

1. A reversible heat-sensitive recording medium comprising a support;

a heat-sensitive layer formed on top of the support, which layer comprises a resin matrix and a low molecular weight organic compound dispersed in said matrix, and a transparency of which is reversibly changeable depending on the temperature, wherein an electrically conductive powder is contained in at least a part of the support and heat-sensitive layer.

2. A reversible heat-sensitive recording medium as claimed in claim 1, which further comprises a protective layer formed on top of the heat-sensitive or on the underside of the support, or intermediate layers formed between the support and each layer, wherein an electrically conductive powder is contained in at least a part of the support, the heat sensitive layer, the protective layer and the intermediate layers.

3. A reversible heat-sensitive recording medium as claimed in claim 1, wherein said electrically conductive powder has a minor axis of 1 $\mu$m or less.

* * * * *